United States Patent [19]

Graiff et al.

[11] Patent Number: 4,687,034

[45] Date of Patent: Aug. 18, 1987

[54] CONTROLLED RELEASE INSERT FOR A DIESEL FUEL SUPPLY NOZZLE AND METHOD OF ADDING A PETROLEUM SUBSTRATE OVER SAID INSERT

[75] Inventors: Leonard B. Graiff, Gatesheath Hall, England; Robert T. Holmes, Houston, Tex.

[73] Assignee: Shell Oil Company, Houston, Tex.

[21] Appl. No.: 867,664

[22] Filed: May 28, 1986

[51] Int. Cl.[4] ..... B67D 5/04

[52] U.S. Cl. ..... 141/69; 141/392; 141/98; 141/1; 141/11; 252/321; 252/358; 44/57

[58] Field of Search ..... 252/321, 358; 44/57; 239/310, 315, 418, 423, 424, 429.3, 591; 137/268; 406/47, 49; 366/336, 340; 422/256, 261, 263; 141/1, 392, 98, 11, 69; 222/190

[56] References Cited

U.S. PATENT DOCUMENTS

| | | | |
|---|---|---|---|
| 3,235,502 | 2/1966 | Waldmann | 252/321 |
| 3,698,452 | 10/1972 | Waxlak | 141/286 |
| 3,805,856 | 4/1974 | McLennand | 141/286 |
| 3,809,084 | 5/1974 | Hansen | 239/315 X |
| 3,838,798 | 10/1974 | Voss | 222/148 |
| 3,937,399 | 2/1976 | Halley | 239/1 |
| 4,009,118 | 2/1977 | Laiho | 252/321 |
| 4,012,334 | 3/1977 | Raleigh et al. | 252/321 |
| 4,039,469 | 8/1977 | Raleigh | 252/358 |
| 4,082,690 | 4/1978 | Farminer | 252/321 |
| 4,294,280 | 10/1981 | Tom | 137/268 |
| 4,353,876 | 10/1982 | Ballu et al. | 422/263 |
| 4,486,336 | 12/1984 | Pape et al. | 252/321 |
| 4,546,503 | 10/1985 | Casberg | 222/190 X |

FOREIGN PATENT DOCUMENTS

| | | | |
|---|---|---|---|
| 2829261 | 1/1979 | Fed. Rep. of Germany | 252/321 |

*Primary Examiner*—Stephen Marcus
*Assistant Examiner*—Ernest G. Cusick
*Attorney, Agent, or Firm*—Kimbley L. Muller

[57] ABSTRACT

A sleeve is provided to be retrofitted to a diesel fuel tank filling nozzle that has selective leaching properties such that an antifoamant agent, such as a silicon compound, migrates in a selective manner to the surface of the sleeve intermittent to passage of the diesel fuel over the sleeve. An initial gust of the diesel fuel will carry the antifoamant material from the nozzle sleeve into the consumer's fuel tank where it exhibits antifoaming activities and thereby permits a top-up of the diesel fuel tank of the vehicle.

17 Claims, 3 Drawing Figures

CONTROLLED RELEASE INSERT FOR A DIESEL FUEL SUPPLY NOZZLE AND METHOD OF ADDING A PETROLEUM SUBSTRATE OVER SAID INSERT

FIELD OF THE INVENTION

This invention concerns an insert of simple mechanical design which can be retrofitted into an existing supply nozzle of a diesel fuel supply system (nozzle) for passage of diesel fuel to a tank of a motorized vehicle in order to reduce the foaming of the diesel fuel as it enters the fuel tank during filling procedures. In retail and commercial gasoline stations it is desirable, especially along interstate highways, to enable a customer to purchase as much diesel fuel as possible with, of course, the limitation on the size of the vehicle's fuel tank. Most retail and commercial supply pumps are equipped with pressure activating nozzles which sense a pressure differential in the tank of the vehicle and the volume of fuel added to the tank and automatically shut off the flow of the diesel fuel through the nozzle when the sensed pressure indicates that the tank is approaching surfeitness. One problem particular to diesel fuel addition is that the diesel fuel tends to foam and thereby distorts this differential pressure sensation leading to premature diesel fuel shutoff through the supply nozzle.

There is a continuing need for reliable but inexpensive means to eliminate foaming of a diesel fuel by means of liquid additives to the liquid diesel fuel. However, most silicon additives, which can be added to a large supply tank reservoir in a retail or commercial outlet are only marginally soluble in the fuel and tend to collect as a monomolecular layer of silicon additive on the surface of the diesel fuel where they reduce foaming in the large reservoir. In pumping the diesel fuel into a user's tank from the bottom-pumping reservoir, the main portion of the silicon additive floating on the surface of the diesel fuel will not pass to the smaller tank to eliminate foaming problems in the smaller tank. In addition, this solution to foaming problems results in an unwanted accumulation of a silicon additive in the diesel fuel tank reservoir which is undesirable.

BACKGROUND OF THE INVENTION

Without wishing to constrict the technology field which concerns this invention, it may be helpful to delineate that Class 141, directed to fluent material handling, with receiver or receiver contacting mean, contains Subclass 286 which reads on technology with a multiple passage filling means for diverse materials with baffle, spreader, displacer, drip ring filter or screen. In addition, Subclass 392 relates to miscellaneous fluent material handling contacting means, such as filling heads. In Class 222, which relates to dispensing, Subclass 566 concerns nozzles, spouts and pouring devices. These particular subclasses may be among many subclasses which are pertinent to the background of this invention. References classified in the above subclasses pertinent to this invention include McLennand, U.S. Pat. No. 3,805,856; Waxlax, U.S. Pat. No. 3,698,452; and Voss, U.S. Pat. No. 3,838,798.

In Waxlax, the problem of foam interference within a filling of a bottle is overcome by a vertical filling tube having a porous nozzle adapted to be inserted to the vessel to be filled. Liquid is then discharged from the side of the nozzle in extremely fine streams. This nozzle is formed of powdered metal or ceramic materials. In McLennand, a nozzle is provided, which is porous, for discharging foamable material to a similar closed container. The end of the nozzle comprises two annular evenly spaced screens separated apart by two struts. The porous walls of the screens are formed from cylindrical screens of extremely fine mesh (such as 50 to 100 microns) to provide a double porous wall with a slight spacing therebetween to reduce the velocity of the liquid and change the pattern of flow to become smoother and to direct the flow downwardly. The pressure forcing the fluid through the perforated nozzle is increased without problems of foam formation.

In Voss, aluminum killed steels are poured through a specially constructed nozzle, without problems of aluminum slag formation, by providing a blanket of an inert gas about the inside surface of the bore of the nozzle. The blanket of inert gas also prevents nozzle erosion. These references, even in their combination, fail to address the problem of foaming in a diesel fuel tank and also fail to provide a simple mechanical apparatus for elimination of undesirable foaming.

SUMMARY OF THE INVENTION

This invention relates to a simple mechanical implantable time release for a diesel fuel supply nozzle composed of a silicon compound impregnated into a plastic matrix which functions to selectively release a sum certain predetermined quantity of silicon compound to the surface of the matrix whereby the diesel fuel passing thereover will carry the antifoam silicon compound additive into the fuel tank and thereby eliminate foaming problems.

OBJECTS AND EMBODIMENTS

An object of this invention is to provide a simple, mechanical device for retrofit into an existing diesel fuel nozzle delivery system to eliminate foaming problems.

Another object of this invention is to provide a means by which a time release sleeve can be secured to the interior of a diesel fuel supply nozzle so as to advantageously release a small predetermined portion of a silicon antifoaming agent into every initial placement of diesel fuel passing into an automotive consumer's fuel tank.

Another object of this invention is to provide a feasible means by which an antifoaming agent can be selectively added to a diesel fuel material and thereby eliminate foaming problems during the introduction of the diesel fuel to a fuel tank.

Yet another object of this invention is to provide a controlled and selective means whereby a small amount of additive is selectively augmented to a petroleum substrate in order to take advantage of properties of the additive in admixture with the petroleum substrate.

One embodiment of this invention resides in a weeping sleeve for a diesel fuel injection nozzle which comprises a time release matrix of an impregnated plastic with a silicon compound as an antifoamant.

Another embodiment of this invention resides in an apparatus for insertion to an existing diesel fuel injection nozzle which comprises a plastic matrix with a selective time release agent of a silicon compound.

Another embodiment of this invention resides in an apparatus for adding a select amount of a chemical additive to a petroleum substrate which comprises a dispensing nozzle having a relatively cylindrical interior side wall for dispensing of a controlled amount of said petroleum substrate, a petroleum substrate first supply reservoir communicating with said dispensing nozzle by communication means wherein said first supply reservoir and dispensing nozzle communication means communicate with a pumping means for withdrawal of said petroleum substrate from said petroleum substrate first supply reservoir for passage through said nozzle for dispensing said petroleum substrate to a second supply reservoir, a time release sleeve securably attached to said interior side wall of said dispensing nozzle comprising a time-release substrate and said chemical additive, wherein during periods of time that said petroleum substrate is not passing over said time release sleeve, said sleeve provides, through time release interaction of said time release substrate with the atmosphere, a select quantity of said chemical additive to the surface of said substrate which is flushed or carried into said second supply reservoir by said passage of said petroleum substrate thereover.

Another embodiment of this invention resides in a method for adding a petroleum substrate to a second supply reservoir from a first supply reservoir through a conduit and nozzle having a time release sleeve securably attached thereto, which method comprises passing said petroleum substrate from said first supply reservoir through said conduit and through said nozzle wherein said passage of said petroleum substrate is in contact with said time release sleeve to admix with a selected preordained amount of chemical additive situated on the surface of the time release sleeve by means of controlled time release of said chemical additive to the atmosphere, whereby said petroleum substrate and said chemical additive pass through said nozzle and into said second supply reservoir.

DETAILED DESCRIPTION OF THE INVENTION

The formation of foam during passage of diesel fuel from large supply tank (usually underground) to a small supply tank (usually attached to a vehicle or the like) results in premature cutoff of automatic dispensing mechanisms, underfilling of the vehicle tank and loss of retail sales. The production of foam also results in spillage during refilling creating an unpleasant odor and pollution problems.

There is a continuing need for a reliable but inexpensive means of adding very small quantities of select liquid chemical additives to liquid petroleum products as they are being dispersed. This invention was developed to meet that need; i.e. to provide a select small quantity of chemical additive to a petroleum substrate and specifically to add a silicone compound to diesel fuel to reduce foaming problems. This invention provides an additive-impregnated plastic matrix to slowly and selectively release a liquid additive to its surface, which is washed off by a petroleum substrate passing thereover. The characteristics of the plastic matrix and additive are adjusted to provide the desired rate of additive release.

This invention provides a simple mechanical device to add small select quantities of chemical additive while dispensing fuel, such as a diesel fuel, into a motor vehicle's tank. The use of complicated metering facilities at each diesel dispenser is avoided by this inexpensive apparatus. This invention also provides an apparatus for controlled chemical additive injection into a diesel fuel which is installed by relatively unskilled personnel and which is replaced at established intervals when the same has become spent or depleted over passage of time or use.

Addition of silicon compounds to each dispensed increment of diesel fuel acts to eliminate or mitigate foaming problems. However, a problem of selectively and incrementally adding the silicon anti-foamant compound has never been adequately resolved.

The quantity of the silicon compound added to the diesel fuel in this invention will be from about 1 to 100 ppm, preferablly from 2 to 20 ppm and most preferably 5 ppm based on the total volume of the diesel fuel. The silicon additive is slightly abrasive, and if added in a small enough quantity will act as a cleansing agent for the diesel engine. However, if an uncontrolled amount silicon compound is added, abrasive silicon compounds act to damage the diesel engine or at best provide a large amount of unwanted entrained air which causes fuel injection system maladies. It is therefore desirable to formulate a time release sleeve with a polymeric matrix, such as polyvinylchloride, to selectively weep or leach a small, but certain predetermined quantity of silicon fluid, preferably from 1 to 100 ppm per fill-up of a vehicle's tank.

The time release sleeve releases additive not in response to the petroleum product but in response to ambient air when dispensing is not being undertaken. The silicon compound is carried into the vehicle's tank for its antifoaming capabilities by means of the diesel fuel passing thereover as a carrier material. The time release sleeve can be prepared by any method sufficient to provide a time released migration of the silicon compound to the surface of the sleeve over a short period of time. The time release sleeve must function at varying temperatures, such as −25° F. to 125° F., between dispersements. The time release sleeve must also be constructed with a proper impregnation so that if a large amount of time is consumed between dispensings only a certain amount of the silicon compound will leach or weep to the surface, after which time release ceases.

The time release sleeve is constructed to release to the surface of the sleeve, for removal during diesel fuel dispensing, of the required amount of silicon compound of up to 100 ppm. After this quantity has leached to the surface, the time release process ceases until a dispensement of the diesel fuel has been undertaken at least once. Typical silicon compounds are those which will exhibit antifoaming properties and which are compatible with the selected polymeric substrate. Examples of these silicon compounds include silicon halides, such as chloro, fluoro, bromo or iodo-silicon, silicon halohydrides such as silicon hydrofluoride, tetrahalo silicons, such as silicon tetrachloride, trichlorosilane, monosilanes, disilanes, trisilanes, silanols, siloxanes, alkoxysilanes, organosilicon compounds, silicon ethers, silicon esters, tetraethoxysilane, tetra(2-ethylbutoxy)silane, tetrakis(2-methoxyethoxy)silane, silicones having the formulation of $(R_nSiO_{4-n/2})_m$ wherein R is an organic group, n is an integer between 0 and 3 and m is 2 or more, dimethyl silicone resins, and dimethyl silicone fluids. These silicon compounds need only possess antifoam properties when added to a diesel fuel and also be compatible with the polymeric matrix. A most preferred silicon compound is sold by the Dow Corning ® marketed under the name of Antifoam A compound, Antifoam Q compound, and Dow Corning ® 200 fluid. These have been defined as silicon fluids which are crystal clear in nature and can have varying viscosities, however, the most viscous material is probably preferred. A preferred viscosity of the silicon fluid is about 350 centistokes. Other suitable silicon compounds may be utilized as antifoaming materials as long as they would regularly have an antifoam influence upon the diesel fuel and are polymer compatible.

The silicon compounds are situated in a time release polymer which has been preferably plasticized to improve the malleability of the sleeve. Suitable plasticizing materials include inert compounds including phthalate esters, such as dioctyl phthalate, diphenyl phthalate, dicyclohexyl phthalate, dimethyl phthalate and the dihexyl phthalates; the sebacates, such as dipentyl sebacate, n-butyl benzyl sebacate and dibenzyl sebacate; and the adipates, such as dioctyl adipate, dicapryl adipate, diisobutyl adipate, and dinonyl adipate. Other compatible plasticizers, such as the hydrocarbon resinous plasticizers exemplified by hydrogenated polyphenyls and alkylated aromatic hydrocarbon, and polyester plasticizers, e.g., polyesters of such polyols as hexanediol and such polycarboxylic acids as sebacic and adipic acid having molecular weights of about 2000, may also be used.

The polymeric matrix which enables the controlled time release of the antifoamant includes block copolymers, either linear or branched in their configurations. While molecular weight does not form an essential aspect of the present invention, the usual molecular weight range is between about 20,000 and 500,000, normally between about 30,000 and 150,000. The block copolymers especially useful in the present compositions are block copolymers of conjugated dienes with mono-alpha-alkenyl arenes as well as the hydrogenated derivatives thereof including block copolymers in which alpha monoolefin polymer blocks may be used in place of, or in addition to, hydrogenated diene blocks. Normally these will have at least one block A comprising a mono-alpha-alkenyl arene polymer block or its hydrogenated derivative and at least one block B comprising a conjugated diene polymer block hydrogenated derivative or the poly(alpha-monoolefin) equivalent of the latter. Where, in the specification and claims, reference is made to hydrogenated conjugated diene polymer blocks, this will be understood to include equivalent poly(alpha-monoolefin) blocks as well.

Preferably, the block copolymers have the general configuration selected from the group A-B$(A)_m$, A-B-$(B\text{-}A)_n$ or A-$(B\text{-}A)_n$ wherein each A and B is as defined above, m is 0 or 1 and n is an integer from 2 to 5 preferably 2 or 3). Wherever adjacent polymer blocks are substantially identical, e.g., B—B, they are to be regarded as a single polymer block. The block copolymers may be either linear or branched in their configuration and are made by processes already known in the art of polymerization such as by solution polymerization involving lithium initiators. The proportion of A or B blocks in the block copolymer does not constitute an essential aspect of the present invention; however, where elastomeric properties are to be imparted to the composition, it is preferred that the block copolymer contain at least 50 wt. percent of elastomeric copolymer (B) blocks. Block copolymers having more than 50% of the thermoplastic block, i.e., a blocks, are operable in the present compositions for the purpose of improving the processability of the compositions and their compatibility.

The monomers from which the blocks A may be formed are typified by styrene or alkylated styrene, especially alpha-methyl styrene. The conjugated dienes are represented by butadiene and isoprene as well as their homologs giving up to about 8 carbon atoms per molecule. While the individual block polymer weights are not an essential aspect of the present invention, blocks A will normally have average molecular weights in the order of 5,000 to 100,000, preferably 10,000 to 50,000. The blocks B will usually have average molecular weights in the order of 15,000 to 500,000, usually 35,000 to 150,000. The following species are typical of the block copolymers contemplated, it being stressed that for the sake of simplicity in the following list, only block copolymers having three blocks are specified.

Poly(alpha-methyl styrene)-polyisoprene-poly(alphamethyl styrene); polystyrene-polyisoprene-polystyrene; and polystyrene-polybutadiene-polystyrene.

In addition to these block copolymers as listed above, partially, i.e., selectively, randomly or completely hydrogenated derivatives thereof may be employed in addition to or in place of a non-hydrogenated species. Preferably, if the polymer is selectively hydrogenated any conjugated diene polymer blocks are hydrogenated while monoalpha-alkenyl arene polymer blocks are essentially unaltered, or at least no more than 25% hydrogenated. The following species typify selectively hydrogenated block copolymers: Poly(alpha-methyl styrene)-(hydrogenated polyisoprene)-poly(alpha-methyl styrene); Polystyrene-(hydrogenated polybutadiene)-polystyrene; Polystyrene-(hydrogenerated polyisoprene)-polystyrene.

If the mono-alpha-alkenyl arene polymer blocks are hydrogenated as well as the conjugated diene polymer blocks, the products obtained are typified by the following: Polyvinyl cyclohexane-(hydrogenated polyisoprene)-polyvinyl cyclohexane; Polyvinyl cyclohexane-(hydrogenated polybutadiene)-polyvinyl cyclohexane.

Substantially equivalent block copolymers may be prepared or supplied in which hydrogenation steps may be avoided by block polymerizing a mono-alpha-alkenyl arene with one or more alpha monoolefins, for example, hydrogenated polyisoprene blocks are regarded as being substantially equivalent to ethylene-propylene copolymer blocks wherein the ratio of ethylene and propylene are essentially 1:1.

Furthermore, suitable block copolymers may be employed wherein the order to blocks A and B are reversed from that given in the general formula set hereinabove so that the blocks A are "interior" blocks and the blocks B either hydrogenated or non-hydrogenated are end blocks. The generic formulae for such alternatives are as follows:

$$B\text{-}A\text{-}(B)_m B\text{-}A\text{-}(A\text{-}B)_n \text{ and } B\text{-}(A\text{-}B)_n$$

wherein m and n are as previously described.

The compositions particularly contemplated may preferably have the following proportions of the essential components:

| | |
|---|---|
| Silicon compound | .01–10 wt. |
| Inert Plasticizer | 0–40% wt. |
| Polyvinyl chloride resin | 20–75% wt. |
| Block Copolymer | 1–30% wt. |

In addition to the essential components, other additional materials may be utilized such as supplementary plasticizers, oil, or other extenders, pigments and supplementary resins. Stabilizers for any one of the components may also be employed.

The silicon compound may be impregnated in the polymeric substrate with a solvent to control viscosity and surface wetting characteristics, which solvent is preferably a non-aromatic hydrocarbon. These hydrocarbon solvents may be either a lower ketone such as acetone, methylethyl ketone, methylisopropyl ketone, mineral spirits or lower alcohols such as methanol or ethanol. Other equivalent solvents may also be utilized as long as they are hydrocarbonaceous materials of non-cyclic or cyclic saturated configuration.

The method of securement per se of the time release sleeve to the interior of the diesel fuel nozzle is not dispositive to this invention. It is preferred only that the sleeve be securely held in place with a simple securement means anywhere in the nozzle to guarantee that the nozzle will not release the time release sleeve into a vehicle's gas tank. Certain types of mechanical securement means are of course available, such as a simple fastening means, i.e. a screw or the like. One advantage of this invention is the ability of the time release sleeve to be adapted to the supply nozzle by relatively unskilled labor in a filling station to quickly change the sleeve once it has become depleted, i.e. every other month or so. One contemplated securement means is shown in the instant drawings. Other securement means may also be available, such as a set of spring snaps on the end of the nozzle to grip the exterior of the extreme end of the nozzle. Another conventional type of device is a friction snaplock or set of snaplocks to securely hold the time release sleeve in place. As a supply nozzle for a diesel fuel tank is approximately 8 to 10 inches in length, it is preferred that the time release sleeve be manufactured with a length of no more than 6 to 8 inches in length. It is also important considering the advantageous use of the sleeve that it be easily removable from the interior of the nozzle at the command of anyone who desires to change the time release. This can be done by many embodiments such as the aforementioned snaplock or friction fit with a certain portion of the sleeve extending a small distance past the end of the supply nozzle. A simple tool can also be devised to disengage the sleeve from the supply nozzle.

DETAILED DESCRIPTION OF THE DRAWINGS

Figure 1:
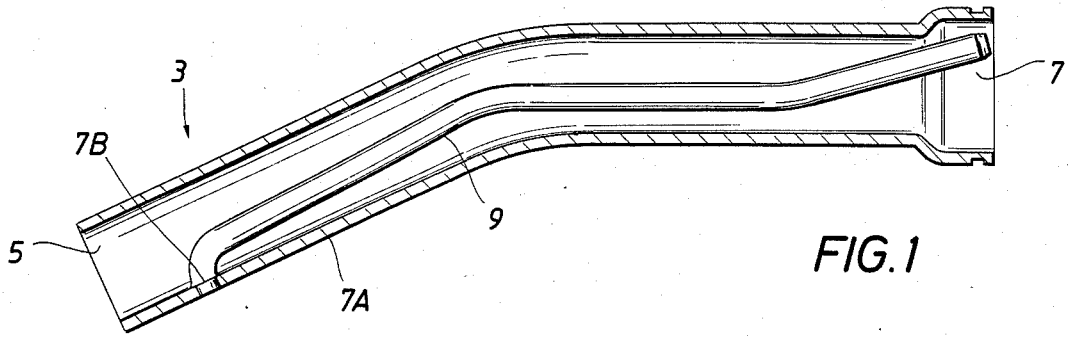
FIG. 1 is a cross-sectional view of a diesel fuel filling nozzle with an appropriate vent tube.
Figure 2:
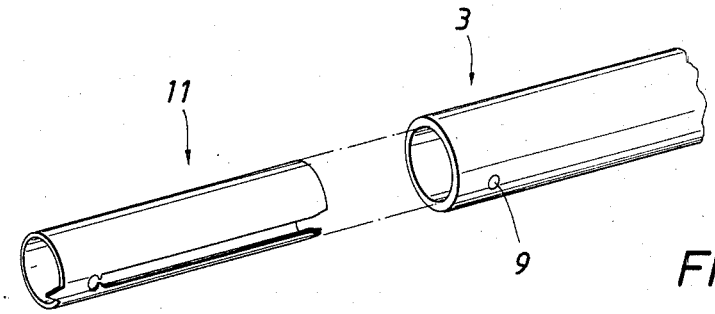
FIG. 2 shows an exploded view of the chemical additive time release sleeve and nozzle.
Figure 3:
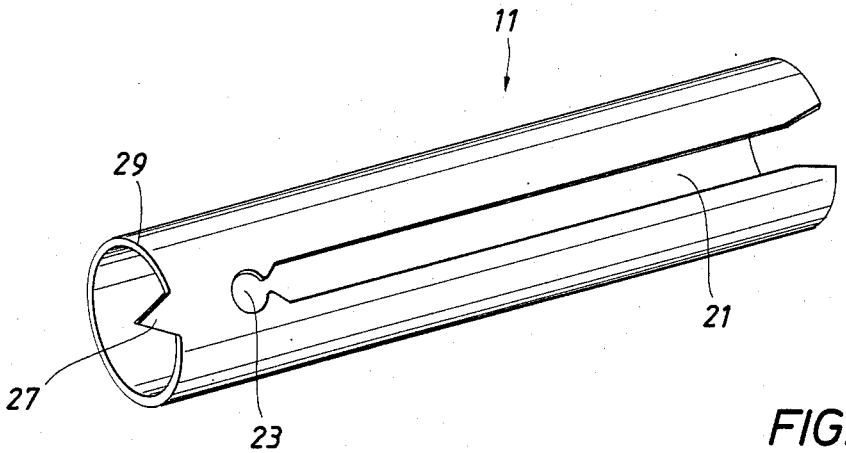
FIG. 3 shows the time release sleeve of this invention.

FIG. 1 shows in cross-section a conventional diesel fuel nozzle 3 having at one extreme an outlet 5 for the passage of diesel fuel to a vehicle tank (not shown) and having a second extreme 7 of the fuel nozzle which communicates with a supply reservoir containing diesel fuel. To cause shut-off of the automatic nozzle 3, a pressure sensing tube 9 is positioned securely to one side of nozzle 7A having an aperture in the side 7A shown as 7B. As shown in FIG. 2, the time released sleeve 11 is inserted into nozzle 3 and secured to the sensing tube at 9 and 7B. The surface of the time release sleeve is a polymeric surface which releases, in a time selective predetermined manner responsive to ambient atmosphere, an anti-foam silicon compound. A channel in the sleeve is formed at 21 with a notch 23 at one extreme of channel 21 opposite that which communicates with an open end of the sleeve 11. This notch 23 is manufactured to receive sensing tube 9 by snapping thereover and thereby securing the time release to the interior of the supply nozzle. Protruding member 27 extends at least a small diameter past the open end of the supply nozzle to provide easy removal of the insertable sleeve and an easy means by which to check that the time release sleeve is still in its desired location. Other attachment means, such as a resilient annular clip, may be placed at nozzle extreme 29 to engage the exterior of nozzle tube 3 either as a secondary securement means or as a primary means to ensure that the time release sleeve does not become disengaged from the interior of the nozzle tube during passage of diesel fuel thereover.

What we claim as our invention is:

1. A sleeve for a fuel tank nozzle having an interior lining which comprises a time release polymeric matrix impregnated with an anti-foam silicon compound.

2. The sleeve of claim 1 wherein said impregnated polymer is situated within said interior lining of said fuel tank nozzle.

3. An apparatus for insertion to a fuel tank nozzle which comprises a plastic polymer matrix constructed with selective time release of a silicon anti-foam compound.

4. An apparatus for adding a select amount of a chemical additive to a petroleum substrate which comprises:

(a) a dispensing nozzle having a relatively cylindrical interior side wall for dispensing of a controlled amount of said petroleum substrate;

(b) a petroleum substrate first supply reservoir communicating with said dispensing nozzle by connection means wherein said first supply reservoir and said nozzle connection means communicate with a pumping means for withdrawal of said petroleum substrate from said petroleum substrate first supply reservoir for passage through said connection means to said nozzle and passage through said nozzle for dispensing said petroleum substrate to a second supply reservoir; and (c) a time release sleeve securably attached to said interior side wall of said dispensing nozzle comprising a time-release substrate and said additive, wherein during periods of time that said petroleum substrate is not passing over said weeping sleeve, said sleeve provides, through interaction of said time release substrate with the atmosphere, a select quantity of said additive to migrate to the surface of said substrate and thereby pass into said second supply reservoir by means of the said passage of said petroleum substrate over said sleeve.

5. The apparatus of claim 4 wherein said dispensing nozzle is a diesel fuel tank dispensing nozzle, said petroleum substrate is a diesel fuel, said supply reservoir is a diesel fuel supply reservoir, said connection means comprises a conduit connecting said diesel fuel supply reservoir with said diesel fuel dispensing nozzle and said pumping means comprises a fluid pump for passage of said diesel fuel through said diesel fuel supply nozzle.

6. The apparatus of claim 5 wherein said time release sleeve comprises a matrix polyvinyl chloride impregnated with an organosilicon compound and wherein said organosilicon compound is impregnated to selectively leach a portion of said organosilicon compound to the surface of said polyvinyl chloride substrate during incremental times when said petroleum substrate comprising a diesel fuel is not passing over said substrate.

7. The apparatus of claim 4 wherein said time release sleeve is securably attached to said interior side wall of said dispensing nozzle by securement means, wherein said time release sleeve and said dispensing nozzle communicate at an extreme end of said time release sleeve and said dispensing nozzle.

8. The apparatus of claim 4 wherein said dispensing nozzle possesses a ventilation means communicating with said interior side wall of said dispensing nozzle and wherein said time release sleeve is securably attached to said dispensing nozzle through communication of said sleeve with said ventilation means.

9. The apparatus of claim 4 wherein said time release sleeve securely attached to said interior side wall of said dispensing nozzle extends beyond said dispensing nozzle to provide extraction of said time release sleeve.

10. The apparatus of claim 4 wherein said connection of said securably attached time release sleeve and said dispensing nozzle comprises a multitude of spring clips formed at the extreme of said securably attached time release sleeve.

11. A method for adding a petroleum substrate from a first supply reservoir to a second supply reservoir through a conduit and nozzle having a sleeve securably attached thereto which method comprising passing said petroleum substrate from said first supply reservoir through said conduit and through said nozzle, wherein said passage of said petroleum substrate contacts said sleeve to admix with a select amount of additive selectively situated on the surface of the sleeve by means of a controlled time release matrix to leach said additive to the atmosphere, whereby said petroleum substrate and said additive pass through said nozzle and into said second supply reservoir.

12. The method of claim 11, wherein said additive comprises a silicon antifoamant compound to decrease unwanted foam accumulation in said second reservoir.

13. The method of claim 12, wherein said silicon antifoamant compound is present in a concentration range of from about 2 ppm to about 20 ppm based on said volume of said petroleum substrate.

14. The method of claim 13, wherein said silicon antifoamant compound is present in admixture with a non-aromatic hydrocarbon solvent in a concentration of from about 10% solvent to about 90% solvent.

15. The method of claim 14, wherein said non-aromatic hydrocarbon comprises a hydrocarbon selected from the group consisting of a lower ketone, mineral spirits and an alcohol.

16. The method of claim 15, wherein said lower ketone comprises acetone.

17. The method of claim 11, wherein said additive is a silicon compound selectively impregnated to said sleeve to provide a select concentration of from about 2 to about 20 ppm silicon fluid per volume of said petroleum substrate during passage of said petroleum substrate in contact with said silicon fluid containing sleeve.

* * * * *